US010256032B2

(12) United States Patent
Jeong

(10) Patent No.: US 10,256,032 B2
(45) Date of Patent: Apr. 9, 2019

(54) ELECTRONIC COMPONENT

(71) Applicant: SAMSUNG ELECTRO-MECHANICS CO., LTD., Suwon-Si, Gyeonggi-Do (KR)

(72) Inventor: Dong Jin Jeong, Suwon-Si (KR)

(73) Assignee: SAMSUNG ELECTRO-MECHANICS CO., LTD., Suwon-si, Gyeonggi-do (KR)

( * ) Notice: Subject to any disclaimer, the term of this patent is extended or adjusted under 35 U.S.C. 154(b) by 198 days.

(21) Appl. No.: 14/930,888

(22) Filed: Nov. 3, 2015

(65) Prior Publication Data

US 2016/0211071 A1 Jul. 21, 2016

(30) Foreign Application Priority Data

Jan. 19, 2015 (KR) ..... 10-2015-0008750

(51) Int. Cl.

| | |
|---|---|
| ***H01F 27/29*** | (2006.01) |
| ***H01F 17/00*** | (2006.01) |
| ***H01F 27/36*** | (2006.01) |
| *H01F 27/255* | (2006.01) |

(52) U.S. Cl.

CPC ..... *H01F 27/292* (2013.01); *H01F 17/0013* (2013.01); *H01F 27/365* (2013.01); *H01F 27/255* (2013.01); *H01F 2017/008* (2013.01)

(58) Field of Classification Search

USPC ..... 336/192, 83, 185, 199, 200, 207, 232

See application file for complete search history.

(56) References Cited

U.S. PATENT DOCUMENTS

| | | | | |
|---|---|---|---|---|
| 3,946,350 | A * | 3/1976 | Goto | H01F 27/324 336/208 |
| 5,578,981 | A * | 11/1996 | Tokuda | H01F 17/0013 333/185 |
| 8,174,349 | B2 | 5/2012 | Yoshida et al. | |
| 2005/0012581 | A1* | 1/2005 | Ono | H01F 1/1475 336/90 |
| 2010/0157565 | A1* | 6/2010 | Yoshida | H01F 27/292 361/811 |

(Continued)

FOREIGN PATENT DOCUMENTS

| | | |
|---|---|---|
| CN | 101763933 A | 6/2010 |
| CN | 104051145 A | 9/2014 |

(Continued)

OTHER PUBLICATIONS

Chinese Office Action issued in corresponding Chinese Patent Application No. 201510849038.0, dated Jun. 28, 2018, with English Translation.

*Primary Examiner* — Elvin G Enad
*Assistant Examiner* — Kazi Hossain
(74) *Attorney, Agent, or Firm* — Morgan Lewis & Bockius LLP

(57) ABSTRACT

An electronic component includes: a magnetic body; first and second internal coil parts embedded in the magnetic body to be spaced apart from each other and including coil conductors disposed on first and second support members; and a spacer part disposed between the first and second internal coil parts and suppressing mutual interference of magnetic fields generated by the first and second internal coil parts.

19 Claims, 6 Drawing Sheets

(56) References Cited

U.S. PATENT DOCUMENTS

| | | | | |
|---|---|---|---|---|
| 2011/0291790 | A1* | 12/2011 | Okumura | H01F 17/0013 336/200 |
| 2013/0015719 | A1* | 1/2013 | Jung | H04B 5/0037 307/104 |
| 2013/0222101 | A1* | 8/2013 | Ito | H01F 17/04 336/83 |
| 2014/0266543 | A1 | 9/2014 | Park et al. | |
| 2014/0285305 | A1 | 9/2014 | Yoo et al. | |

FOREIGN PATENT DOCUMENTS

| | | | | |
|---|---|---|---|---|
| CN | 104078221 | A | | 10/2014 |
| JP | 10270256 | A | * | 10/1998 |
| JP | H10270256 | A | | 10/1998 |
| JP | 2000299227 | A | | 10/2000 |
| KR | 10-2005-0011090 | A | | 1/2005 |

* cited by examiner

I-I'

ELECTRONIC COMPONENT

CROSS-REFERENCE TO RELATED APPLICATION

This application claims benefit of priority to Korean Patent Application No. 10-2015-0008750 filed on Jan. 19, 2015, with the Korean Intellectual Property Office, the disclosure of which is incorporated herein in its entirety by reference.

BACKGROUND

The present disclosure relates to an electronic component and a board having the same.

An inductor, an electronic component, is a representative passive element configuring an electronic circuit, together with a resistor and a capacitor, to remove noise therefrom.

In order to decrease an area required for the mounting of passive elements on a printed circuit board, an array-type inductor in which a plurality of internal coil parts are disposed may be used.

SUMMARY

An aspect of the present disclosure may provide an electronic component capable of suppressing harmful mutual interference of magnetic fields generated by a plurality of internal coil parts disposed in the electronic component, and a board having the same.

According to an aspect of the present disclosure, an electronic component may include: a magnetic body; first and second internal coil parts embedded in the magnetic body to be spaced apart from each other and including coil conductors disposed on first and second support members; and first and second spacer parts disposed between the first and second internal coil parts in the magnetic body and provided at first and second side surfaces of the magnetic body in a width direction of the magnetic body, respectively, with a predetermined interval therebetween.

According to another aspect of the present disclosure, an electronic component may include: a magnetic body; first and second internal coil parts embedded in the magnetic body to be spaced apart from each other and including coil conductors disposed on first and second support members; and a spacer part disposed between the first and second internal coil parts and suppressing mutual interference of magnetic fields generated by the first and second internal coil parts.

According to an aspect of the present disclosure, an electronic component may include: a magnetic body; first and second internal coil parts embedded in the magnetic body to be spaced apart from each other; and first and second spacer parts disposed between the first and second internal coil parts in the magnetic body with a predetermined interval therebetween. The first and second spacer parts may be formed of a material different from a material of the magnetic body.

BRIEF DESCRIPTION OF DRAWINGS

The above and other aspects, features and advantages of the present disclosure will be more clearly understood from the following detailed description taken in conjunction with the accompanying drawings, in which.

DETAILED DESCRIPTION

Figure 1:
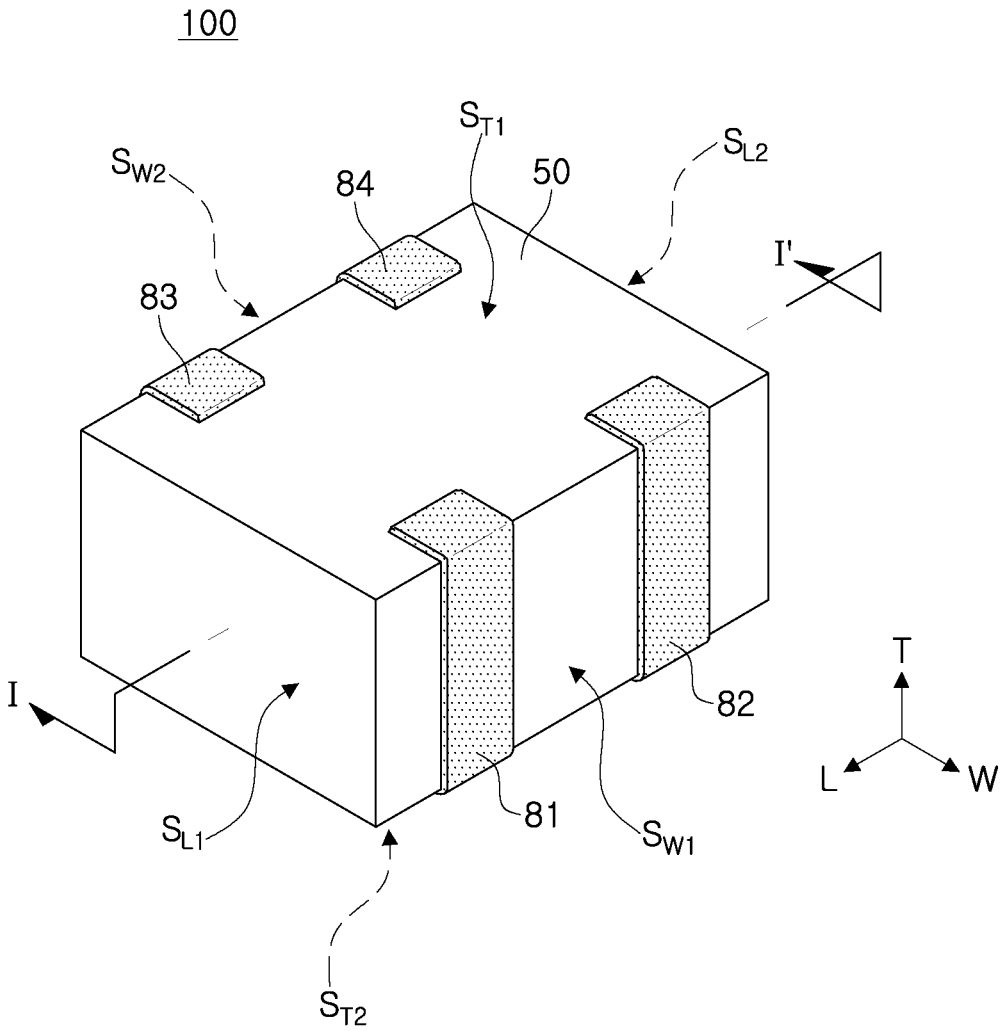
FIG. 1 is a perspective view of an electronic component according to an exemplary embodiment in the present disclosure.

Hereinafter, embodiments of the present disclosure will be described in detail with reference to the accompanying drawings.

The disclosure may, however, be embodied in many different forms and should not be construed as being limited to the embodiments set forth herein. Rather, these embodiments are provided so that this disclosure will be thorough and complete, and will fully convey the scope of the disclosure to those skilled in the art.

In the drawings, the shapes and dimensions of elements maybe exaggerated for clarity, and the same reference numerals will be used throughout to designate the same or like elements.

Electronic Component

Hereinafter, an electronic component according to an exemplary embodiment, particularly, a thin film type inductor, will be described. However, the electronic component according to exemplary embodiments is not limited thereto.

Figure 2:
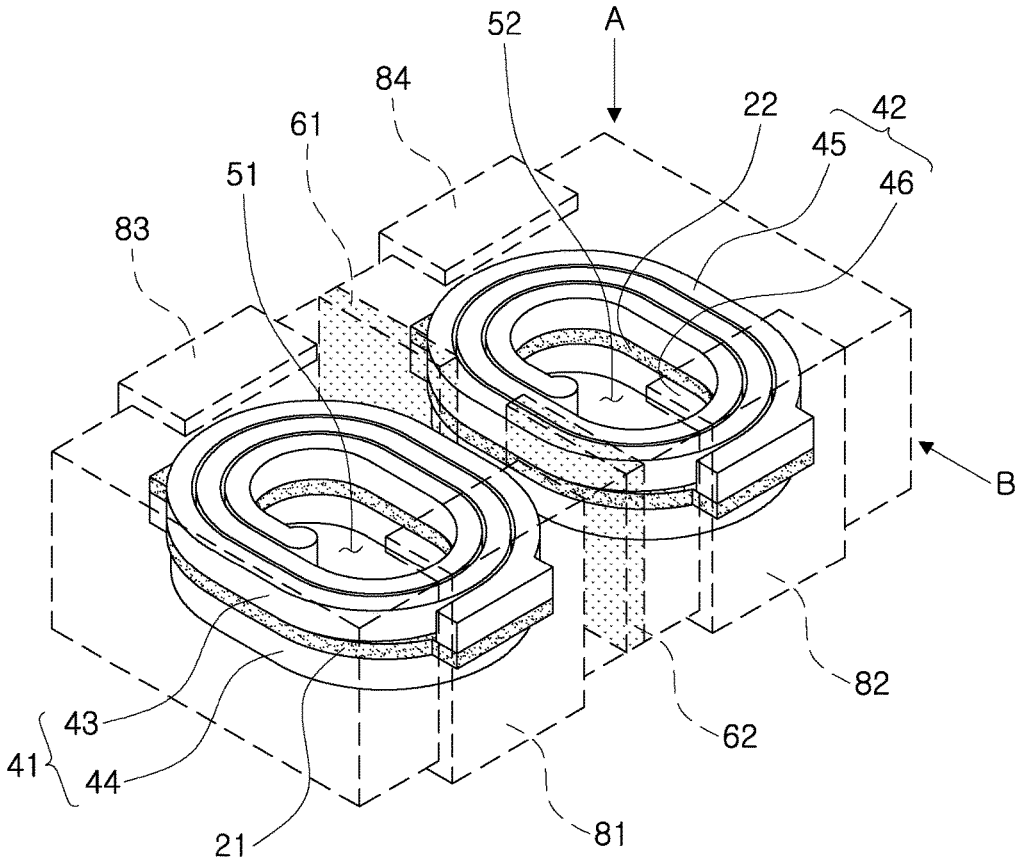
FIG. 2 is a perspective view of internal coil parts in the electronic component according to the exemplary embodiment in the present disclosure.

FIG. 1 is a perspective view of an electronic component according to an exemplary embodiment in the present disclosure, and FIG. 2 is a perspective view of internal coil parts in the electronic component according to the exemplary embodiment.

Referring to FIGS. 1 and 2, as an example of the electronic component, a thin film type inductor used for a power line of a power supply circuit is disclosed.

An electronic component 100 according to the exemplary embodiment may include a magnetic body 50, first and second internal coil parts 41 and 42 embedded in the magnetic body 50, first and second spacer parts 61 and 62 disposed between the first and second internal coil parts 41 and 42, and first to fourth external electrodes 81 to 84 disposed on external surfaces of the magnetic body 50.

In the exemplary embodiment in the present disclosure, ordinal numbers such as "first and second", "first to fourth", and the like, are used in order to distinguish objects, and are not limited to the order thereof.

In the electronic component 100 according to an exemplary embodiment in the present disclosure, a 'length' direction refers to an 'L' direction of FIG. 1, a 'width' direction refers to a 'W' direction of FIG. 1, and a 'thickness' direction refers to a 'T' direction of FIG. 1.

The magnetic body 50 may have first and second end surfaces $S_{L1}$ and $S_{L2}$ opposing each other in the length (L)

direction thereof, first and second side surfaces $S_{W1}$ and $S_{W2}$ connecting the first and second end surfaces $S_{L1}$ and $S_{L2}$ to each other and opposing each other in the width (W) direction thereof, and first and second main surfaces $S_{T1}$ and $S_{T2}$ opposing each other in the thickness (T) direction thereof.

The magnetic body 50 may contain any material as long as the material exhibits magnetic properties. For example, the magnetic body 50 may contain ferrite or a magnetic metal powder.

The ferrite may be, for example, an Mn—Zn based ferrite, an Ni—Zn based ferrite, an Ni—Zn—Cu based ferrite, an Mn—Mg based ferrite, a Ba based ferrite or an Li based ferrite.

The magnetic metal powder may be a crystalline or amorphous metal powder containing one or more selected from the group consisting of iron (Fe), silicon (Si), boron (B), chromium (Cr), aluminum (Al), copper (Cu), niobium (Nb), and nickel (Ni).

For example, the magnetic metal powder may be an Fe—SI—B—Cr based amorphous metal powder.

The magnetic metal powder may be dispersed in a thermosetting resin such as an epoxy resin or polyimide, to thereby be contained in the magnetic body 50.

The magnetic body 50 may include the first and second internal coil parts 41 and 42, disposed to be spaced apart from each other.

That is, the electronic component 100 according to the exemplary embodiment may be an array-type inductor having a basic structure in which two or more internal coil parts are disposed.

The first and second internal coil parts 41 and 42 may be formed by connecting first coil conductors 43 and 45 formed on one surfaces of first and second support members 21 and 22 disposed to be spaced apart from each other in the magnetic body 50, and second coil conductors 44 and 46 formed on the other surfaces of the first and second support members 21 and 22 opposing the one surfaces thereof, respectively. The first and second support members 21 and 22 may be spaced apart from each other and aligned to each other on the same plane.

The first coil conductors 43 and 45 may have the form of planar coils formed on the same plane of the first and second support members 21 and 22, respectively. The second coil conductors 44 and 46 may have the form of planar coils formed on the other same plane of the first and second support members 21 and 22, respectively.

Each of first and second coil conductors 43 to 46 may have a spiral shape. The first and second coil conductors 43 and 44 formed on one surface and the other surface of the first support member 21 may be electrically connected to each other by a via (not illustrated) penetrating through the first support member 21. The first and second coil conductors 45 and 46 formed on one surface and the other surface of the second support member 22 may be electrically connected to each other by a via (not illustrated) penetrating through the second support member 22.

The first and second coil conductors 43 to 46 may be formed by performing electroplating on the support members 21 and 22, but a method of forming the first and second coil conductors 43 to 46 is not limited thereto.

The first and second coil conductors 43 to 46 and the vias may be formed of a metal having excellent electric conductivity, for example, silver (Ag), palladium (Pd), aluminum (Al), nickel (Ni), titanium (Ti), gold (Au), copper (Cu), platinum (Pt), or alloys thereof.

The first and second coil conductors 43 to 46 may be coated with an insulation film (not illustrated) to thereby not directly contact the magnetic material forming the magnetic body 50.

The first and second internal coil parts 41 and 42 may be disposed to be symmetrical to each other in relation to a central portion of the magnetic body 50 in the length (L) direction of the magnetic body.

The first and second support members 21 and 22 may be, for example, a polypropylene glycol (PPG) substrate, a ferrite substrate, or a metal-based soft magnetic substrate.

The first and second support members 21 and 22 may have through holes penetrating through central portions thereof, wherein the through holes are filled with a magnetic material, thereby forming first and second core parts 51 and 52. That is, the first and second core parts 51 and 52 may be formed inwardly of the first and second internal coil parts 41 and 42, respectively.

As the first and second core parts 51 and 52 formed of the magnetic material are formed inwardly of the first and second internal coil parts 41 and 42, inductance L may be improved.

The first and second internal coil parts 41 and 42 may be disposed to be spaced apart from each other by a predetermined interval in the length (L) direction of the magnetic body, and the first and second spacer parts 61 and 62 may be disposed between the first and second internal coil parts 41 and 42.

The first and second spacer parts 61 and 62 may be disposed in the magnetic body 50 with a predetermined interval therebetween. The first and second spacer parts 61 and 62 may have a plate shape disposed perpendicular to the length (L) direction. The first and second space parts 61 and 62 may be exposed to the first and second side surfaces $S_{W1}$ and $S_{W2}$ of the magnetic body 50 in the width (W) direction of the magnetic body 50, respectively. The first and second space parts 61 and 62 may also be exposed to the first and second main surfaces $S_{T1}$ and $S_{T2}$ of the magnetic body 50 in the thickness (W) direction of the magnetic body 50.

According to the exemplary embodiment, the spacer parts 61 and 62 may be disposed between the first and second internal coil parts 41 and 42, such that harmful mutual interference of the magnetic fields generated by the plurality of internal coil parts may be suppressed.

In a case of an array-type electronic component in which a plurality of internal coil parts are disposed, malfunctioning of a product may occur and efficiency may be deteriorated due to harmful interference between the internal coil parts.

Further, as electronic components have been miniaturized, an interval between a plurality of internal coil parts embedded in the electronic component has been decreased, such that it may be difficult to suppress harmful interference between the internal coil parts only by adjusting shapes of the internal coil parts and position relationships therebetween.

Therefore, according to the exemplary embodiment in the present disclosure, the first and second spacer parts 61 and 62 may be formed between the first and second internal coil parts 41 and 42 in the magnetic body 50 and provided at the first and second side surfaces $S_{W1}$ and $S_{W2}$ of the magnetic body 50 in the width (W) direction of the magnetic body, respectively, such that harmful mutual interference of the magnetic fields generated by the plurality of internal coil parts may be suppressed.

The first and second spacer parts 61 and 62 may be formed of any material as long as the material may suppress harmful mutual interference of the magnetic fields generated by the first and second internal coil parts 41 and 42. In addition, the first and second spacer parts 61 and 62 may be formed of a material different from that of the magnetic body 50.

The material different from that of the magnetic body 50 may also include a material in which the same raw material is contained but a composition thereof, or the like, is different.

For example, the first and second spacer parts 61 and 62 may contain one or more selected from the group consisting of a thermosetting resin, magnetic metal powder, ferrite, and a dielectric material.

The first and second spacer parts 61 and 62 may have magnetic permeability lower than that of the magnetic body 50, such that the first and second spacer parts 61 and 62 may suppress harmful mutual interference of the magnetic fields generated by the first and second internal coil parts 41 and 42.

The first and second internal coil parts 41 and 42 may be electrically connected to the first to fourth external electrodes 81 to 84 disposed on the external surfaces of the magnetic body 50.

The first to fourth external electrodes 81 to 84 may be formed on the first and second side surfaces $S_{W1}$ and $S_{W2}$ of the magnetic body 50 and extend to the first and second main surfaces $S_{T1}$ and $S_{T2}$ of the magnetic body 50 in the thickness (T) direction of the magnetic body 50. The thickness (T) direction of the magnetic body 50 refers to a direction along which the first and second coil conductors 43 and 44 (or the first and second coil conductors 45 and 46) are stacked on each other.

The first to fourth external electrodes 81 to 84 may be disposed to be spaced apart from each other to thereby be electrically separated from each other.

The first to fourth external electrodes 81 to 84 may be formed of a metal having excellent electrical conductivity, for example, silver (Ag), palladium (Pd), aluminum (Al), nickel (Ni), titanium (Ti), gold (Au), copper (Cu), platinum (Pt), or alloys thereof.

Figure 3A:
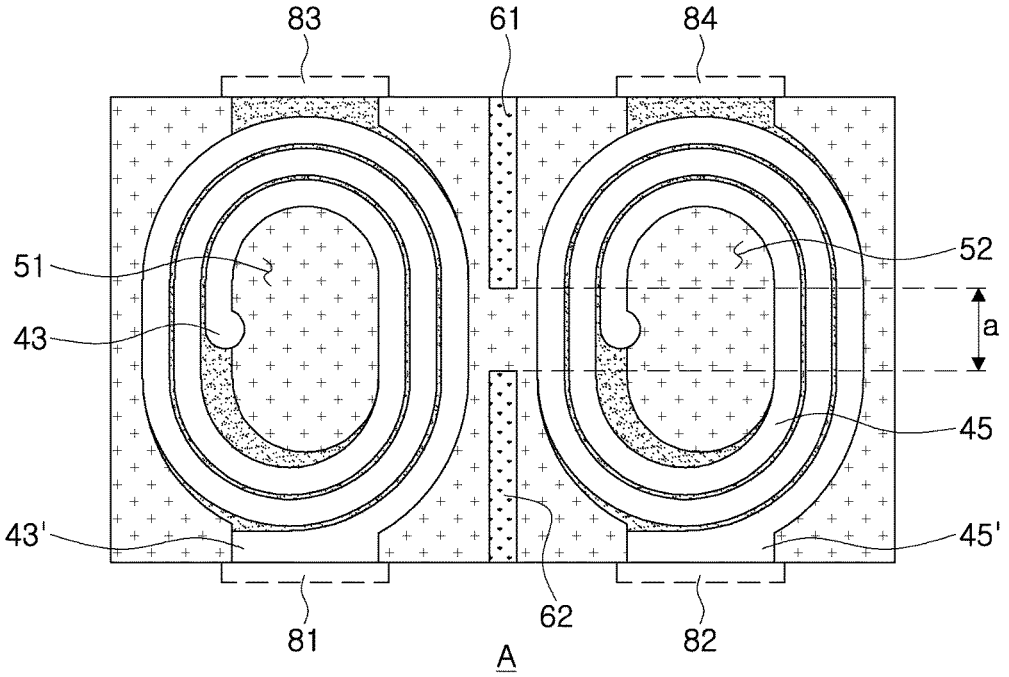
FIGS. 3A and 3B are plan views of an internal portion of the electronic component projected in directions A and B of FIG. 2, respectively.
Figure 3B:
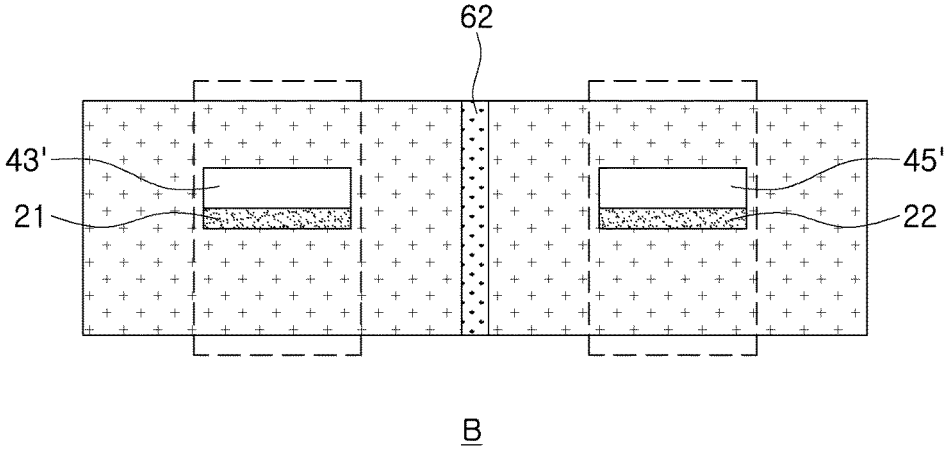

FIG. 3A is a plan view of an internal portion of the electronic component projected in direction A of FIG. 2, and FIG. 3B is a plan view of the internal portion of the electronic component projected in direction B of FIG. 2.

Referring to FIG. 3A, the first and second internal coil parts 41 and 42 may include first lead portions 43' and 45' extending from one end portions of the first coil conductors 43 and 45 and exposed to the first side surface $S_{W1}$ of the magnetic body 50 and second lead portions (not illustrated) extending from one end portions of the second coil conductors 44 and 46 and exposed to the second side surface $S_{W2}$ of the magnetic body 50.

The first lead portions 43' and 45' may be connected to the first and second external electrodes 81 and 82 disposed on the first side surface $S_{W1}$ of the magnetic body 50, and the second lead portions (not illustrated) may be connected to the third and fourth external electrodes 83 and 84 disposed on the second side surface $S_{W2}$ of the magnetic body 50.

The first and second external electrodes 81 and 82 may be input terminals, and the third and fourth external electrodes 83 and 84 may be output terminals, but the first to fourth external electrodes 81 to 84 are not limited thereto.

For example, a current input to the first external electrode 81, the input terminal, may sequentially pass through the first coil conductor 43 of the first internal coil part 41, the via, and the second coil conductor 44 of the first internal coil part 41 to thereby flow to the third external electrode 83, the output terminal.

Similarly, a current input to the second external electrode 82, the input terminal, may sequentially pass through the first coil conductor 45 of the second internal coil part 42, the via, and the second coil conductor 46 of the second internal coil part 42 to thereby flow to the fourth external electrode 84, the output terminal.

The first and second spacer parts 61 and 62 may be disposed in the magnetic body 50 with a predetermined interval therebetween and provided at the first and second side surfaces $S_{W1}$ and $S_{W2}$ of the magnetic body 50 in the width (W) direction of the magnetic body, respectively.

An interval a between the first and second spacer parts 61 and 62 may satisfy 0 μm<a<300 μm.

In a case in which the interval a between the first and second spacer parts 61 and 62 is 0 μm, that is, the first and second spacer parts 61 and 62 are connected to each other, inductance may be deteriorated, and strength of the magnetic body 50 may be deteriorated due to the spacer parts, and in a case in which the interval a is more than 300 μm, malfunctioning of a product may occur and efficiency may be deteriorated due to harmful mutual interference of the magnetic fields generated by the first and second internal coil parts 41 and 42.

Mutual interference between the first and second internal coil parts 41 and 42 may be adjusted and a coupling value may be controlled by adjusting the interval a between the first and second spacer parts 61 and 62.

Referring to FIG. 3B, the first and second spacer parts 61 and 62 may extend from the first main surface $S_{T1}$ of the magnetic body 50 to the second main surface $S_{T2}$ thereof in the thickness (T) direction of the magnetic body. That is, the first and second spacer parts 61 and 62 may have a height equal to a thickness T of the magnetic body 50.

Figure 4:
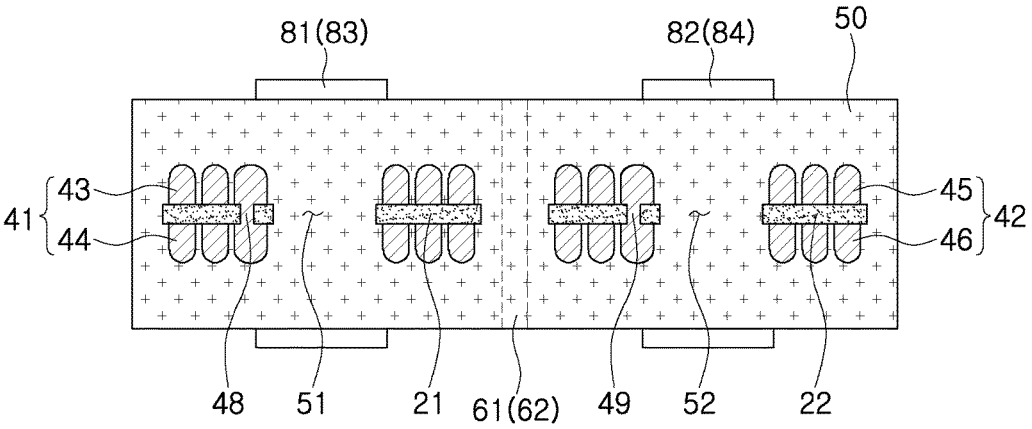
FIG. 4 is a cross-sectional view taken along line I-I' of FIG. 1.

FIG. 4 is a cross-sectional view taken along line I-I' of FIG. 1.

Referring to FIG. 4, the first coil conductors 43 and 45 disposed on one surfaces of the first and second support members 21 and 22 and the second coil conductors 44 and 46 disposed on the other surfaces of the first and second support members 21 and 22 may be connected to each other by vias 48 and 49 penetrating through the first and second support members 21 and 22.

The first and second spacer parts 61 and 62 disposed between the first and second internal coil parts 41 and 42 may be formed at the first and second side surfaces $S_{W1}$ and $S_{W}$2 of the magnetic body 50 in the width (W) direction thereof to be spaced apart from each other in the magnetic body 50.

The coupling value may be controlled by variously changing the height, the interval, the material, or the like, of the first and second spacer parts 61 and 62 to adjust mutual interference between the first and second internal coil parts 41 and 42.

That is, a space between the first and second spacer parts 61 and 62 may include a material which is the same as that of the magnetic body 50.

For example, when the magnetic body 50 includes the magnetic metal powder which is dispersed in a thermosetting resin, the space between the first and second spacer parts 61 and 62 may also include the magnetic metal powder which is dispersed in the thermosetting resin.

Figure 5A:
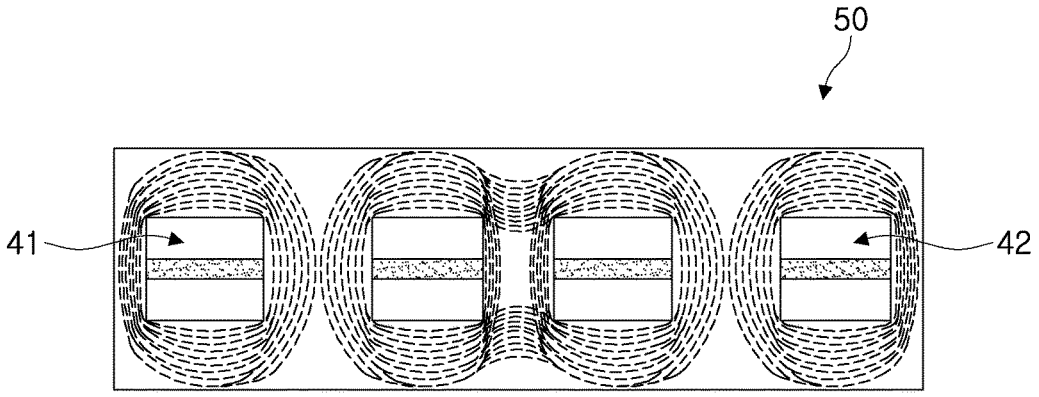
FIG. 5A is a diagram illustrating magnetic fields formed in an electronic component according to the related art in which a spacer part is not provided.
Figure 5B:
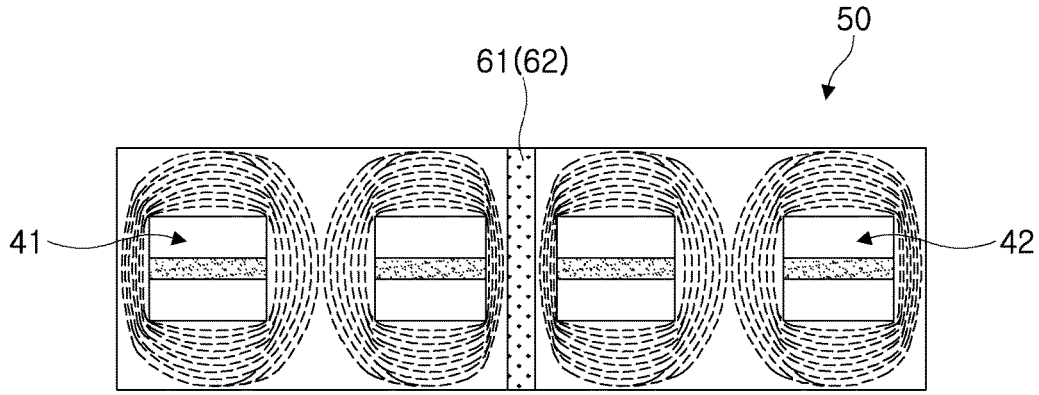
FIG. 5B is a diagram illustrating magnetic fields formed in an electronic component according to an exemplary embodiment in the present disclosure.

FIG. 5A is a diagram illustrating magnetic fields formed in an electronic component according to the related art in which a spacer part is not disposed, and FIG. 5B is a diagram illustrating magnetic fields formed in the electronic component according to the exemplary embodiment in the present disclosure.

Referring to FIG. 5A, in a case of the electronic component in which the spacer part is not disposed, it can be seen that mutual inference of the magnetic fields occurs between first and second internal coil parts 41 and 42.

On the contrary, referring to FIG. 5B, it can be seen that the first and second spacer parts 61 and 62 are disposed between the first and second internal coil parts 41 and 42, such that mutual interference of the magnetic fields between the first and second internal coil parts 41 and 42 may be suppressed.

Board Having Electronic Component

Figure 6:
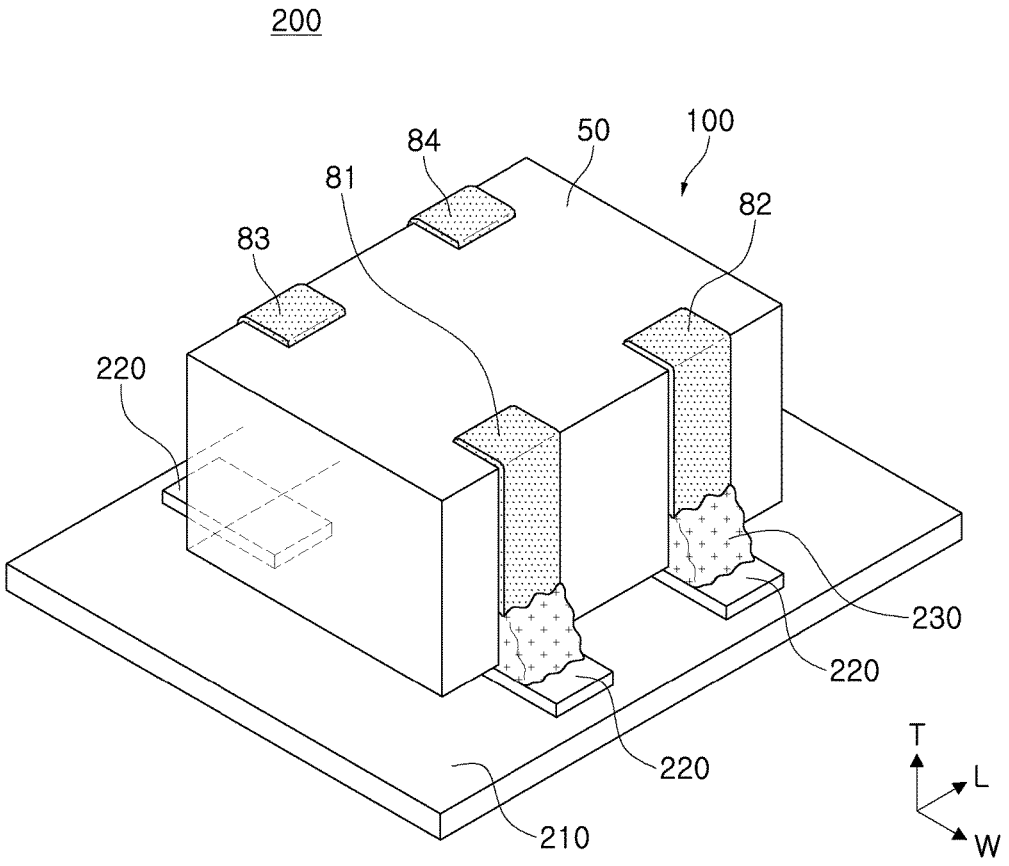
FIG. 6 is a perspective view of a board in which the electronic component of FIG. 1 is mounted on a printed circuit board (PCB).

FIG. 6 is a perspective view of a board in which the electronic component of FIG. 1 is mounted on a printed circuit board (PCB).

Referring to FIG. 6, a board 200 having an electronic component 100 according to the present exemplary embodiment may include a printed circuit board 210 on which the electronic component 100 is mounted and a plurality of electrode pads 220 formed on the printed circuit board 210 to be spaced apart from each other.

The first to fourth external electrodes 81 to 84 disposed on the external surfaces of the electronic component 100 may be electrically connected to the printed circuit board 210 by solders 230 in a state in which the first to fourth external electrodes 81 to 84 are positioned to contact the electrode pads 220, respectively.

Except for the description above, descriptions of features overlapping those of the electronic component according to the previous exemplary embodiment will be omitted.

As set forth above, according to exemplary embodiments in the present disclosure, mutual interference of the magnetic fields generated by the plurality of internal coil parts disposed in the electronic component may be suppressed.

Further, the coupling value may be controlled by adjusting mutual interference between the internal coil parts.

While exemplary embodiments have been shown and described above, it will be apparent to those skilled in the art that modifications and variations could be made without departing from the scope of the present invention as defined by the appended claims.

What is claimed is:

1. An electronic component comprising:

a magnetic body;

first and second internal coil parts embedded in the magnetic body to be spaced apart from each other in a length direction and including coil conductors disposed on first and second support members; and first and second spacer parts disposed between the first and second internal coil parts in the magnetic body, provided at first and second side surfaces of the magnetic body in a width direction of the magnetic body, respectively, and spaced apart from each other in the width direction with a predetermined interval therebetween, wherein within the magnetic body, the first and second internal coil parts are electrically isolated from each other at least by the first and second spacer parts and a material of the magnetic body disposed between the first and second spacer parts, and the first and second support members are separated from each other by the first and second spacer parts and the material of the magnetic body disposed between the first and second support members.

2. The electronic component of claim 1, wherein the first and second spacer parts contain one or more selected from the group consisting of a thermosetting resin, magnetic metal powder, ferrite, and a dielectric material.

3. The electronic component of claim 1, wherein the first and second spacer parts are formed of a material different from the material of the magnetic body.

4. The electronic component of claim 1, wherein the first and second spacer parts extend from a first main surface of the magnetic body to a second main surface thereof in a thickness direction of the magnetic body.

5. The electronic component of claim 1, wherein the predetermined interval between the first and second spacer parts is greater than 0 μm and less than 300 μm.

6. The electronic component of claim 1, wherein a space between the first and second spacer parts includes the material which is the same as a material of the magnetic body.

7. The electronic component of claim 1, wherein the magnetic body contains a magnetic metal powder and a thermosetting resin.

8. The electronic component of claim 1, wherein the coil conductors are formed by plating.

9. The electronic component of claim 1, wherein the first internal coil part includes first and second lead portions exposed to the first and second side surfaces of the magnetic body, respectively, and the second internal coil includes third and fourth lead portions exposed to the first and second side surfaces of the magnetic body, respectively, the first and third lead portions are connected to first and second external electrodes disposed on the first side surface of the magnetic body, respectively, and the second and fourth lead portions are connected to third and fourth external electrodes disposed on the second side surface of the magnetic body, respectively.

10. The electronic component of claim 9, wherein the first and second external electrodes are input terminals, and the third and fourth external electrodes are output terminals.

11. The electronic component of claim 1, wherein each of the first and second spacer parts has a magnetic permeability lower than that of the magnetic body.

12. The electronic component of claim 1, wherein the first and second support members are spaced apart from each other and aligned to each other on a same plane.

13. An electronic component comprising:

a magnetic body;

first and second internal coil parts embedded in the magnetic body to be spaced apart from each other along a length direction of the magnetic body and including coil conductors disposed on first and second support members, respectively; and first and second spacer parts spaced-apart from each other along a width direction of the magnetic body, disposed between the first and second internal coil parts, and suppressing mutual interference of magnetic fields generated by the first and second internal coil parts, wherein within the magnetic body, the first and second internal coil parts are electrically isolated from each other at least by the first and second spacer parts and a material of the magnetic body disposed between the first and second spacer parts, and the first and second support members are separated from each other by the first and second spacer parts and the material of the magnetic body disposed between the first and second support members.

14. The electronic component of claim 13, wherein the spacer part includes first and second spacer parts disposed in the magnetic body with a predetermined interval therebetween and provided at first and second side surfaces of the magnetic body in the width direction of the magnetic body, respectively.

15. The electronic component of claim 13, wherein the spacer part has a magnetic permeability lower than that of the magnetic body.

16. The electronic component of claim 13, wherein the first and second support members are spaced apart from each other and aligned to each other on a same plane.

17. An electronic component comprising:

a magnetic body;

first and second internal coil parts embedded in the magnetic body to be spaced apart from each other along a length direction of the magnetic body and including coil conductors disposed on first and second support members, respectively; and first and second spacer parts disposed between the first and second internal coil parts in the magnetic body, wherein the first and second spacer parts are formed of a material different from a material of the magnetic body, and are spaced-apart from each other along a width direction of the magnetic body by a material for forming the magnetic body disposed between the first and second spacer parts, within the magnetic body, the first and second internal coil parts are electrically isolated from each other at least by the first and second spacer parts and the material for forming the magnetic body disposed between the first and second spacer parts, and the first and second support members are separated from each other by the first and second spacer parts and the material of the magnetic body disposed between the first and second support members.

18. The electronic component of claim 17, wherein each of the first and second spacer parts has a magnetic permeability lower than that of the magnetic body.

19. The electronic component of claim 17, wherein the first and second support members are spaced apart from each other and aligned to each other on a same plane.

* * * * *